US006148708A

United States Patent [19]

Pfeiffer

[11] Patent Number: 6,148,708

[45] **Date of Patent: *Nov. 21, 2000**

[54] CUTTING APPARATUS WITH MOTOR

[75] Inventor: Horst Pfeiffer, Aldingen, Germany

[73] Assignee: Hengstler GmbH, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/545,876

[22] Filed: Oct. 20, 1995

[30] Foreign Application Priority Data

Oct. 21, 1994 [DE] Germany ..... 94 16 958 U

[51] Int. Cl.[7] ..... B26D 1/08; B26D 5/14

[52] U.S. Cl. ..... 83/628; 83/632; 83/635; 83/636; 83/824

[58] Field of Search ..... 83/624, 625, 626, 83/628, 629, 632, 635, 824, 825, 694, 627, 636, 821

[56] References Cited

U.S. PATENT DOCUMENTS

| | | | |
|---|---|---|---|
| 1,569,569 | 1/1926 | Pels | 83/632 X |
| 1,931,979 | 10/1933 | Chandler | 83/660 X |
| 2,639,771 | 5/1953 | Kobler et al. | 83/468.6 |
| 2,832,410 | 4/1958 | Soss | 83/628 |
| 3,678,792 | 7/1972 | Dvorak | 83/635 X |
| 4,936,177 | 6/1990 | Ozawa et al. | 83/628 X |
| 5,090,285 | 2/1992 | Kondo | 83/694 X |
| 5,584,218 | 12/1996 | Schoendienst | 83/694 X |
| 5,658,229 | 8/1997 | Armington et al. | 493/363 |

FOREIGN PATENT DOCUMENTS

| | | | |
|---|---|---|---|
| 144364 | 6/1950 | Australia | 83/685 |
| 4-365591 | 12/1992 | Japan | 83/856 |
| 6-47696 | 2/1994 | Japan | 83/663 |
| 721253 | 3/1980 | U.S.S.R. | 83/635 |
| 695331 | 8/1953 | United Kingdom | 83/694 |

*Primary Examiner*—Clark F. Dexter
*Attorney, Agent, or Firm*—Orum & Roth

[57] ABSTRACT

A cutting device for strip stock includes a stationary blade and a motor-driven, movable blade that continuously contacts against the stationary blade, constituting a point of support. Two other points of support for the movable blade are equally spaced from the cutting edge of the blade and from the sides of the blade. The other two supporting points also function as blade drive points for moving the blade in a reciprocating manner. The drive points are connected to an output shaft of the motor through a gear assembly. A pair of ball bearings on each side of the blade, which are laterally spaced from each other on each respective side of the blade, cooperate with the blade to achieve a very low friction for the device during operation.

3 Claims, 4 Drawing Sheets

CUTTING APPARATUS WITH MOTOR

BACKGROUND OF THE INVENTION

The invention deals with a cutting device for strip stock comprising an electric-motor drive and a stationary blade cooperating with a displaceably supported flat blade.

This kind of cutting device is known and is utilized, for example, for cutting paper strip stock, for example in printers and ticket issuing machines. There are many embodiments of this kind of cutting device, such as, for example, blades rotationally joined like scissors or spirally wound rotary blades cooperating with a spring-loaded stationary blade.

A further variation of such a cutting device, described in DE-OS 35 07 620, utilizes a stationary cutting edge and a longitudinally displaceable flat blade.

In order to obtain a reliable cut, it is known that the flat blade must have a V-shaped cutting edge in plan view and a slightly arched profile in cross-section. Furthermore, the flat blade is preloaded against the stationary blade, whereby the resulting reaction forces are transmitted to lateral sliding guideways. This kind of construction has the disadvantage that friction forces occur in the lateral guideways which must be overcome by the drive of the cutting device. The significant wear incurred by the cutting device is a further disadvantage. Lubrication of the lateral guideways is only conditionally possible, since the dust created during cutting, especially when cutting paper or similar material, would deposit on the lubricant.

It is a further disadvantage of known cutting devices that the force exerted on the blade is applied in only a single point causing asymmetric canting forces which unfavorably increase friction forces in the guideways and therefore wear in the cutting device.

SUMMARY OF INVENTION

Therefore, it is the object of the invention to further develop a cutting device of the type indicated at the beginning in such a way that friction is compensated for or at least reduced.

This object is solved according to the invention by positioning bearing elements on each side of the displaceably supported flat blade, by limiting contact between the displaceably supported flat blade and the cutting edge of the stationary blade, essentially to the cutting edge of the flat blade, so that a three point support of the flat blade is formed, and by driving the displaceably supported flat blade in two points which are positioned essentially symmetrically with respect to its center line.

DETAILED DESCRIPTION OF THE DRAWINGS

Further details and advantages of the invention are given in the exemplary embodiments described below using the Figures wherein.

DETAILED DESCRIPTION OF THE PREFERRED EMBODIMENT

Figure 1:
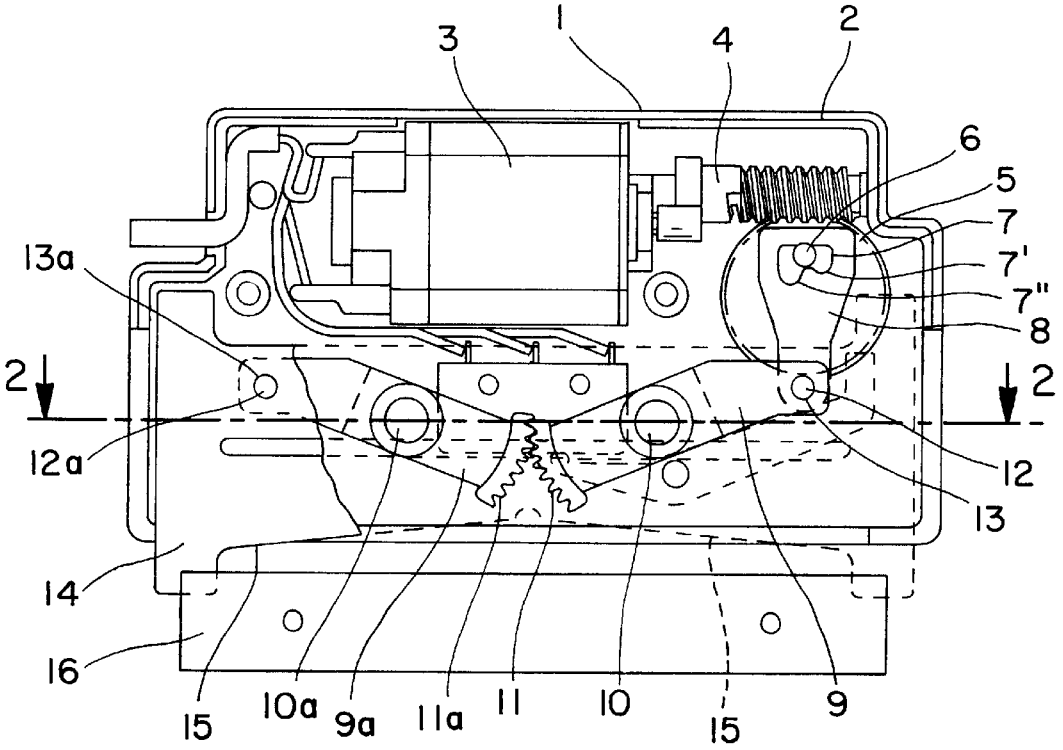
FIG. 1 is a first exemplary embodiment of a cutting device in plan view.
Figure 2:
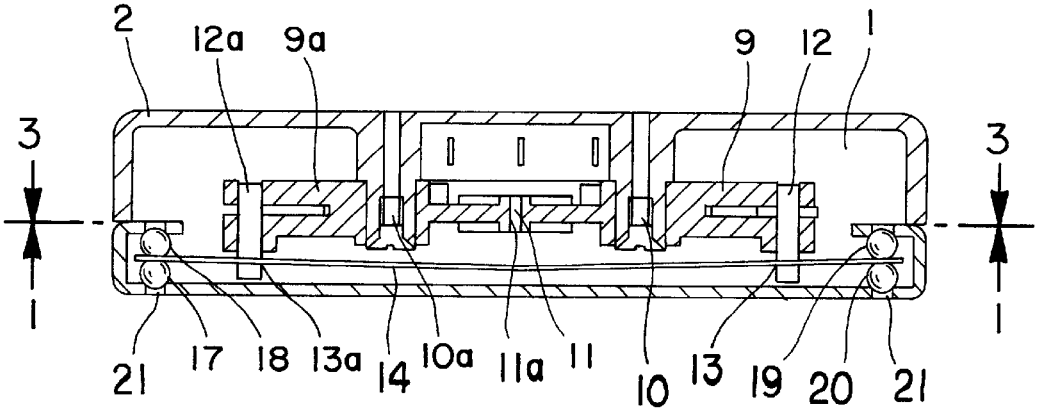
FIG. 2 is a cross-section along line G–H of FIG. 1.

FIGS. 1 through 4 show a first exemplary embodiment of a cutting device 1 showing a housing 2 and a flat blade 14 driven by a drive unit essentially consisting of a drive motor 3 with worm 4 and worm wheel 5 with a driving pin 6 which is engaged in an angled opening 7 at the input end of connecting rod 8. The output end of the connecting rod 8 is connected by means of a rotational joint to output crank 9 which is rotationally supported on pin 10. Gear toothing 11 of output crank 9 is interlocked with corresponding gear toothing 11*a* of second output crank 9*a* which is essentially identical to output crank 9 and which is rotationally supported on pin 10*a*. As can best be seen in FIG. 2 the two driving pins 12, 12*a* project into openings 13, 13*a* in flat blade 14 and thereby embodying the points on flat blade 14 through which it is driven. These points are located essentially symmetrically with respect to its the center line.

Now, the rotary motion of worm wheel 5 induced by drive motor 3 by means of worm 4, is transmitted by means of connecting rod 8 to output crank 9 which executes a swivel motion around pin 10. The swivel motion of output crank 9 is transmitted to output crank 9*a* by means of the interlocking gear toothing 11, 11*a*, so that the flat blade 14, interlocked with output cranks 9, 9*a* by means of driving pins 12, 12*a*, is movable up and down as viewed in FIG. 1.

The symmetric drive of flat blade 14 provided in cutting device 1, achieved by virtue of output cranks 9, 9*a* being arranged essentially symmetrical to each other, is advantageous in that asymmetric canting forces cannot occur advantageously during cutting.

Figure 3:
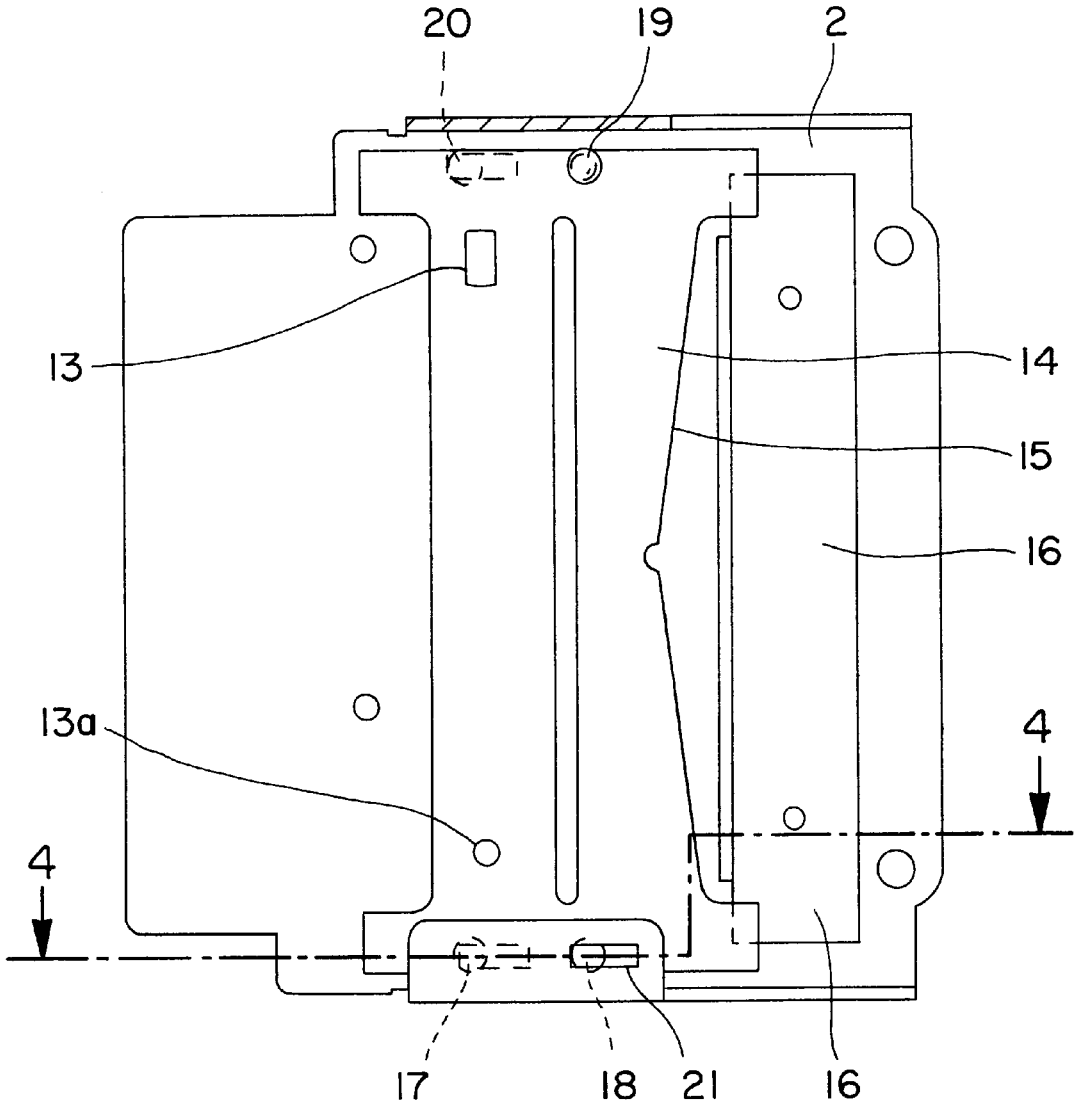
FIG. 3 is a blade assembly of the exemplary embodiment in a plan view (partially sectioned)
Figure 4:
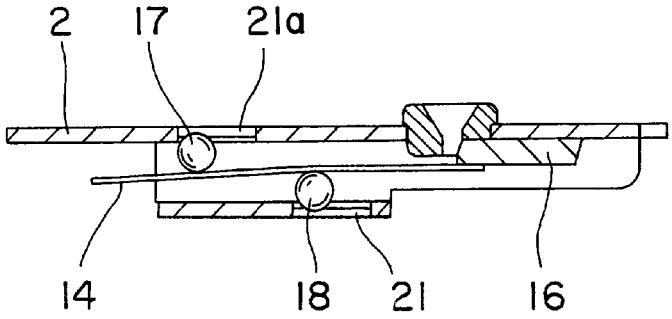
FIG. 4 is a cross-section through FIG. 3 along line E–F.

Flat blade 14 is supported on ball bearings 17–20 captured in two lateral guide slots 21, 21*a*, as can best be seen in FIG. 3 (turned by 90 degrees) and in FIG. 4. The support of flat blade 14 on bearing balls is advantageous, since it provides near friction free travel. Furthermore, during cutting only cutting edge 15 of flat blade 14 of cutting device 1 slides over the stationary blade 16 which is cooperating with flat blade 14, so that particularly low friction is achieved in this area also. Bearing balls 17–20 are advantageously fixtured in guide slots 21, 21*a* by applying a preload on flat blade 14. Because of the three-point support of flat blade 14 by means of bearing balls 17–20 captured in lateral guide slots and the support of flat blade 14 along its cutting edge 15 by the stationary blade 16, the blade assembly consisting of flat blade 14 and stationary blade 16 is in an advantageous manner statically stable. Furthermore, by virtue of the prestress in flat blade 14 of cut-off device 1, positive contact with stationary blade 16 is guaranteed.

Moreover, the described cutting device distinguishes itself in that it can execute in a particularly simple manner a complete cut as well as a partial cut. By virtue of the angled opening 7 in connecting rod 8, turning worm wheel 5 clockwise in FIG. 1 causes driving pin 6 to engage in the more shallow cutout 7' of the two cutouts 7', 7" of opening 7, so that flat blade 14 preferably travels the maximum possible stroke, thereby executing a complete cut through the strip to be cut.

If now the direction of rotation of the motor is reversed and therefore worm wheel 5 is turning in the direction opposite to the one indicated above, drive pin 6 engages in the deeper cutout 7" of opening 7 so that the stroke of flat blade 14 is correspondingly smaller. Because of the preferably V-shaped cutting edge 15, the strip to be cut is now cut only partially, thereby making it possible in a particularly simple manner to execute a partial cut also.

Figure 5:
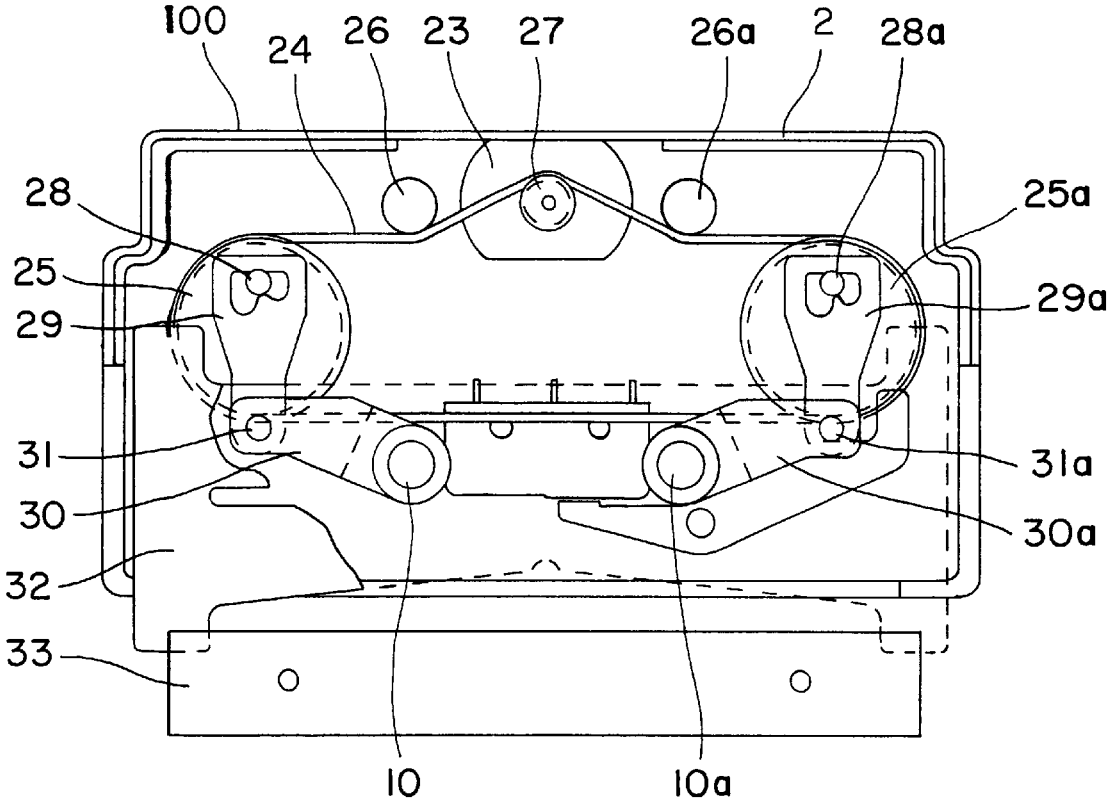
FIG. 5 is a second exemplary embodiment of a cutting device in plan view.
Figure 6:
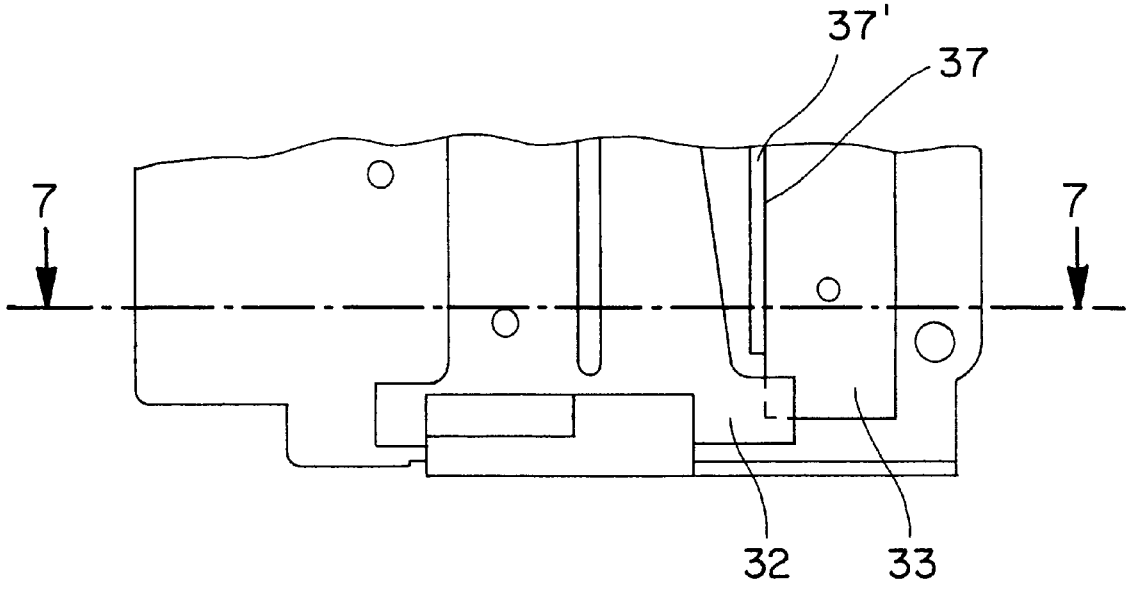
FIG. 6 is a partial view of the exemplary embodiment shown in FIG. 5.
Figure 7:
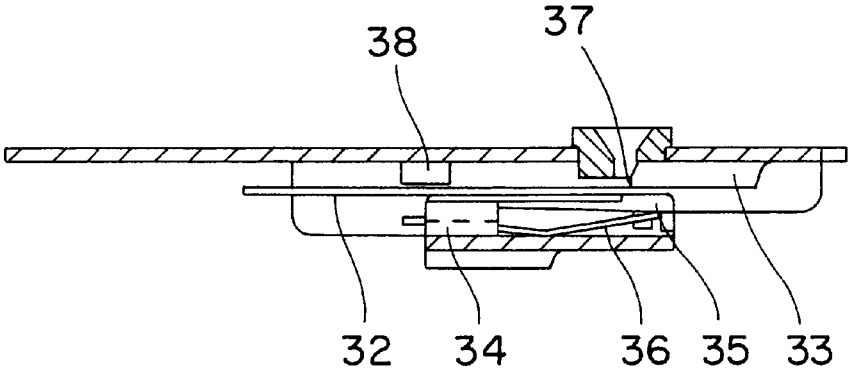
FIG. 7 is a cross-section through the embodiment shown in FIG. 6 along line J–K.

FIGS. 5–7 show a second exemplary embodiment of a cutting device 100. This embodiment shows a housing 2 containing a geared electric motor 23 which, by means of a toothed belt 24, drives drive wheels 25 and 25*a* whose driving pins 28, 28*a* project into connecting rods 29 and 29*a* which are, in turn, connected with output cranks 30, 30*a* which are rotationally supported on pins 10, 10*a*. Output cranks 30, 30*a* are connected to flat blade 32, which corresponds to flat blade 14, by means of driving pins 31, 31*a*. In this manner it is easily possible to transform the rotation of drive wheels 25, 25*a* generated by geared electric motor 23 into a swivel motion of output cranks 30 and 30*a* and thus a reciprocating motion of flat blade 32. Optional corner pulleys 26, 26*a* can be provided in order to increase the angle of grip of the toothed belt 24 around pinion 27 of the geared electric motor 23.

In order to reduce friction in the guide system of flat blade 32 to a minimum and to achieve uniform pressure exerted by flat blade 32 on cutting edge 37 of stationary blade 33, the latter corresponding to stationary blade 16, a guide component 34 cooperating with a stop 38 (see FIG. 7) provides a preload on flat blade 32 laterally, preferably on the level of the cutting edge 37, by means of a sliding shoe 35 and a spring element 36. However, a guide component with built-in spring loading capability is also possible.

The thereby achievable defined blade guide system between stop 38, stationary blade 33 and guide component 34 enables a defined pressure to be exerted between cutting edge 37' of flat blade 32 and cutting edge 37 of stationary blade 33. This kind of measure is advantageous in that it produces a self-sharpening effect.

The advantage of this second embodiment of the cutting device is its adjustability in a particularly simple manner to different work widths, since it is essentially only necessary to adjust the length of the toothed belt correspondingly.

In summary it may be stated that the described exemplary embodiments of the cutting device of the present invention can be realized in shallow construction enabling many different applications in printers and in automatic cutting processes. Because of the friction free support of flat blades 16 and 32 by means of bearing balls 17–20 and components 34, 38, respectively, friction is significantly reduced so that power consumption of the described cutting device 1, 100 is reduced. This has a particularly favorable effect on the heat generation of the cutting device 1,100.

What is claimed is:

1. A cutting device for cutting strip stock comprising:

a housing provided with a pair of identical, laterally spaced bearing elements, each respective bearing element comprised of two slotted walls in spaced confronting relationship, and a respective ball bearing supported and movable in each of said respective slots, each slot being identical and vertically disposed in confronting relationship to the other of the respective bearing unit;

a movable blade interposed between each pair of ball bearings, said movable blade defined by a pair of opposed sides, a pair of opposed lateral ends, and a top and a bottom end, wherein said bottom end comprises a cutting edge, each of said sides of said movable blade including a respective surface, wherein each respective opposed surface is in contact against a respective said ball bearing adjacent each lateral blade end, said movable blade including two laterally spaced openings extending between said opposed surfaces, each of said spaced openings disposed above said cutting edge an equal extent;

a stationary blade fixed to said housing and having a cutting edge;

a drive assembly for displacing said movable blade, said drive assembly connected to a drive unit attached to said movable blade, said drive assembly comprising a drive motor mounted within said housing, a worm connected to a shaft of said drive motor, a wormed wheel enmeshed with said worm, and a connecting rod connected to said wormed wheel, said connecting rod having input and output ends and an angled opening formed in said rod at said input end, said wormed wheel including a driving pin inserted in said angled opening, of said connecting rod, said drive unit comprising a first and second output crank, each of said output cranks having respective input and output ends, said input end of said first crank connected by a drive pin with the output end of said connecting rod, said one drive pin connected to said movable blade through one of said laterally spaced openings in said movable blade so as to form a first support and drive point of said movable blade, said output end of said first output crank provided with toothing, said input end of said second output crank provided with toothing complementary to said toothing on said first output crank and interlocked therewith, said output end of said second output crank connected by another drive pin to said movable blade through insertion of said other drive pin through the other of said laterally spaced openings in said movable blade so as to form a second support and drive point of said movable blade, said movable blade being displaceable at each of said drive points upon movement of each of said driving pins by said drive assembly, wherein said cutting edge of said movable blade continuously contacts along said cutting edge of said stationary blade so that a third support point of said movable blade is maintained and wherein said movable blade is adjustable according to a length of an operating stroke of said connecting rod, said operating stroke length determined by said angled opening provided in said connecting rod, wherein said angled opening is respectively comprised of two vertically oriented cutouts arranged side-by-side, one of said cutouts relatively of longer extent than the other cutout.

2. The cutting device according to claim 1, wherein the drive unit is a symmetrically constructed gear unit.

3. A cutting device for cutting strip stock comprising:

a housing provided with a pair of identical, laterally spaced bearing elements, each respective pair of bearing elements comprised of two walls in spaced, confronting relationship, each wall including an identical guide slot formed therein, said guide slots of each bearing element being in confronting relationship to each other, and a respective ball bearing supported and movable in each of said respective slots, each slot being vertically disposed;

a movable blade interposed between each pair of ball bearings, said movable blade defined by a pair of opposed sides, a pair of opposed lateral ends, and a top and a bottom end, wherein said bottom end of said movable blade comprises a cutting edge, each opposed side of said movable blade having a respective surface, wherein each respective surface is in contact against a respective ball bearing adjacent each lateral end of said movable blade, said moveable blade including two laterally spaced openings extending between said opposed surfaces, each of said openings disposed above said cutting edge an equal extent;

a stationary blade fixed to said housing and having a cutting edge;

a drive assembly for displacing said movable blade, said drive assembly connected to a drive unit attached to said movable blade, said drive assembly comprising an electric motor mounted within said housing above said movable blade, said electric motor having an output shaft and a pinion thereon, a continuous belt movable by said electric motor, a first and a second connecting rod, and a first and a second rotatable drive wheel laterally displaced from each other, each of said drive wheels including a respective driving pin thereon, wherein each connecting rod has a corresponding input and output end and a respective and identical angled opening formed at said input end, said first and second drive wheels respectively connected to said first and second connecting rods through insertion of a respective said driving pin into a respective said angled opening on said connecting rod, and wherein each of said drive wheels is connected to said electric motor through said continuous belt, which said continuous belt is looped about said pinion and each respective drive wheel, a gear unit comprising a first and a second output crank, each out put crank having respective input and output ends, said first output crank connected at said input end to said first connecting rod through a first drive pin, said second output crank connected at said input end to said second connecting rod through a second drive pin, said first drive pin extending through one of said laterally spaced openings on said movable blade, thereby forming a first support and driving point of said movable blade, said second drive pin extending through the other of said laterally spaced openings on said movable blade, thereby forming a second support and driving point of said movable blade, said movable blade displaceable at each of said drive points upon movement of each of said driving pins by said drive assembly, wherein said cutting edge of said movable blade continuously contacts along said cutting edge of said stationary blade so that a third support point of said movable blade is maintained and wherein said movable blade is adjustable according to a respective length of an operating stroke of each of said connecting rods, each stroke length determined through said angled opening provided in said connecting rods, wherein each of said angled openings is respectively comprised of two vertically oriented cutouts arranged side-by-side, one of said cutouts relatively of longer extent than said other cutout.

* * * * *